US009359724B2

(12) United States Patent
Kindler et al.

(10) Patent No.: US 9,359,724 B2
(45) Date of Patent: Jun. 7, 2016

(54) AKD COMPOSITION AND MANUFACTURE OF PAPER AND PAPERBOARD

(71) Applicant: KEMIRA OYJ, Helsinki (FI)

(72) Inventors: Alois Kindler, Gruenstadt (DE); Mari Granstroem, Mannheim (DE); Hubertus Kroener, Neustadt (DE); Holger Kern, Kirchardt (DE)

(73) Assignee: KEMIRA OYJ, Helsinki (FI)

( * ) Notice: Subject to any disclaimer, the term of this patent is extended or adjusted under 35 U.S.C. 154(b) by 0 days.

(21) Appl. No.: 14/356,259

(22) PCT Filed: Nov. 12, 2012

(86) PCT No.: PCT/EP2012/072394

§ 371 (c)(1),
(2) Date: May 5, 2014

(87) PCT Pub. No.: WO2013/072277

PCT Pub. Date: May 23, 2013

(65) Prior Publication Data

US 2014/0305607 A1 Oct. 16, 2014

Related U.S. Application Data

(60) Provisional application No. 61/559,198, filed on Nov. 14, 2011.

(30) Foreign Application Priority Data

Nov. 14, 2011 (EP) ..... 11189013

(51) Int. Cl.

| | |
|---|---|
| ***D21H 21/16*** | (2006.01) |
| ***D21H 17/17*** | (2006.01) |
| *D21H 23/04* | (2006.01) |

(52) U.S. Cl.
CPC ..... *D21H 21/16* (2013.01); *D21H 17/17* (2013.01); *D21H 23/04* (2013.01)

(58) Field of Classification Search
USPC ..... 106/162.1, 163.01, 164.01, 164.4, 106/164.44; 162/179, 158, 164.1, 185
See application file for complete search history.

(56) References Cited

U.S. PATENT DOCUMENTS 3,223,544 A 12/1965 Savina
3,931,069 A * 1/1976 Lundin ..... D21H 17/17 106/162.8

(Continued)

FOREIGN PATENT DOCUMENTS

CN 1109125 A 9/1995
CN 1587515 A 3/2005

(Continued)

OTHER PUBLICATIONS

Reynolds, W. ed.,The Sizing of Paper. Second edition, TAPPI Press, 1989, pp. 33-39.*

(Continued)

*Primary Examiner* — Dennis Cordray
(74) *Attorney, Agent, or Firm* — Oblon, McClelland, Maier & Neustadt, L.L.P

(57) ABSTRACT

AKD cellulosic composition obtainable by flowing a stream of a cellulosic suspension through a shearing device and in which a molten alkyl ketene dimer (AKD) is metered in to the stream of cellulosic suspension in or prior to the shearing device. The AKD cellulosic composition is particularly suitable in the manufacture of sized paper and paperboard.

11 Claims, 3 Drawing Sheets

(56) References Cited

U.S. PATENT DOCUMENTS

| | | | | |
|---|---|---|---|---|
| 4,913,775 | A * | 4/1990 | Langley et al. | 162/164.3 |
| 4,964,915 | A | 10/1990 | Blixt et al. | |
| 5,190,584 | A | 3/1993 | Ruffini | |
| 5,407,537 | A | 4/1995 | Malatesta et al. | |
| 5,779,859 | A * | 7/1998 | Carter | D21H 23/14 162/168.2 |
| 6,093,217 | A | 7/2000 | Frolich et al. | |
| 6,306,255 | B1 | 10/2001 | Frolich et al. | |
| 6,602,994 | B1 * | 8/2003 | Cash | A61K 8/027 536/100 |
| 2014/0345816 | A1 * | 11/2014 | Heiskanen | D21H 11/18 162/158 |

FOREIGN PATENT DOCUMENTS

| | | | |
|---|---|---|---|
| CN | 102080342 | A | 6/2011 |
| CN | 102220729 | A | 10/2011 |
| DE | 33 16179 | A1 | 11/1984 |
| DE | 101 14 284 | A1 | 9/2002 |
| DE | 102 37 911 | A1 | 2/2004 |
| DE | 102 37 912 | A1 | 2/2004 |
| EP | 0 353 212 | A1 | 1/1990 |
| EP | 0 432 838 | A1 | 6/1991 |
| EP | 1 314 822 | A1 | 5/2003 |
| WO | WO 91/02119 | A1 | 2/1991 |
| WO | WO 96/26318 | A1 | 8/1996 |
| WO | WO 98/41565 | A1 | 9/1998 |
| WO | WO 03/064767 | A1 | 8/2003 |
| WO | WO 2010/131016 | A2 | 11/2010 |
| WO | WO 2011/004300 | A1 | 1/2011 |
| WO | WO 2011/004301 | A1 | 1/2011 |
| WO | WO 2011/051882 | A1 | 5/2011 |

OTHER PUBLICATIONS

Smook, Gary A., Handbook for Pulp and Paper Technologists, 2nd ed, Angus Wilde Publications, 1992, p. 228.*

International Search Report issued Jun. 4, 2013 in PCT/EP2012/072394.

International Preliminary Report on Patentability and Written Opinion issued May 30, 2014 in PCT/EP2012/072394.

Chinese Search Report issued Feb. 15, 2015 in Patent Application No. 201280054840.5 (with English Translation of Category of Cited References).

* cited by examiner

AKD COMPOSITION AND MANUFACTURE OF PAPER AND PAPERBOARD

The present invention relates to a method of preparing sized paper or paperboard employing an alkyl ketene dimer (AKD). The invention also relates to a novel AKD composition.

It is known to use reactive sizes such as alkyl ketene dimer for the purpose of sizing paper. Alkyl ketene dimers are very effective reactive sizes but are hydrophobic and are usually solid at ambient temperatures such as 25° C. It is therefore necessary to put the alkyl ketene dimer into a more convenient form that can be utilised in the papermaking process. Typically alkyl ketene dimers are put into an aqueous dispersion for this purpose.

DE-A-3 316 179 describes AKD dispersions which comprise polymers comprising ethylenimine units and a water-soluble dicyandiamide/formaldehyde condensate. Although the latter increases the rate of development of the sizing (i.e. promoter effect), it does not contribute towards stabilizing the dispersion.

U.S. Pat. No. 3,223,544 as well as EP-A-0 353 212 discloses alkyldiketene (AKD) dispersions with cationic starch as a protective colloid and an anionic dispersant as a stabilizer.

WO-A-96/26318 discloses AKD dispersions which comprise, as protective colloids, either copolymers of N-vinylpyrrolidone and N-vinylimidazole or condensates based on polyethylenimines. The preparation of these AKD dispersions is very complicated owing to the copolymerization or condensation of the protective colloids.

Other AKD dispersions suitable for sizing are described in German patent publication 10 237911, German patent publication 10 237912 and WO-A-98/41565.

Although such AKD dispersions provide very convenient and effective sizing agents for paper, they have the disadvantage that they require special formulation usually employing protective colloids and sometimes other additives in order to produce a stable dispersion product.

WO 2011/051882 describes a process for producing microfibrillated cellulose (nanocellulose) in an extruder. The process requires adding a slurry of fibres to an extruder and treating the slurry in the extruder so that the fibres form defibrillated and microfibrillated cellulose. It is indicated that the process can include adding at least one modifying chemical into the extruder during the treatment. Preferably the fibres of slurry may be pretreated with an enzyme before being conducted to and treated in the extruder. It is indicated that if the fibres are hydrophobised, for example with AKD, modified microfibrillated cellulose can be used for hydrophobisation of papers and board or composites. There is no indication of how this would be achieved.

WO 2011/004300 describes a process for treating cellulosic fibres comprising mechanically pretreating the fibres, treating the fibres with an enzyme, and mixing the fibres with a solution comprising an alkali metal hydroxide in order to expand the fibres and then mechanically treat the expanded fibres form microfibrillated cellulose.

WO 2011/004301 describes a process for treating cellulosic fibres which involves treating the fibres with an enzyme in a first enzymatic treatment, mechanically pretreating fibres in a first mechanical treatment, treating the fibres with an enzyme in a second enzymatic treatment and mechanically treating the fibres in a second mechanical treatment to form microfibrillated cellulose.

Figure 1:
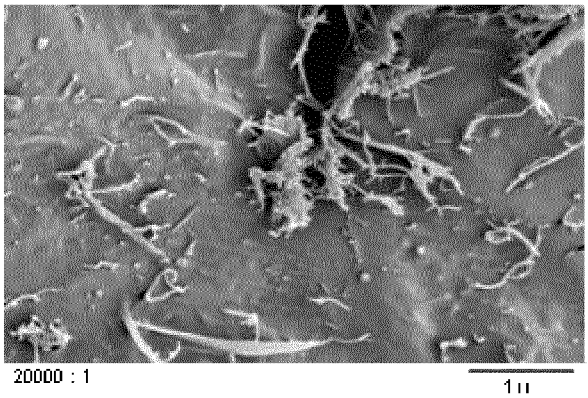
FIG. 1 is an SEM image of sample 1.

The inventors have developed a more convenient method of sizing paper using AKD that avoids the application of formulated AKD dispersions.

Thus according to the first aspect of the present invention we provide a process for the preparation of sized paper or paperboard comprising forming a first cellulosic suspension, optionally adding to the first cellulosic suspension one or more papermaking additives, and then draining the first cellulosic suspension on a moving screen to form a sheet, and then drying the sheet wherein a second stream of a cellulosic suspension is flowed through a shearing device and in which a molten alkyl ketene dimer (AKD) is metered in to the second stream of cellulosic suspension in or prior to the shearing device to form an AKD cellulosic composition, and then metering the AKD cellulosic composition into the first cellulosic suspension.

The AKD cellulosic composition is a novel composition.

Thus in a second aspect of the present invention we provide an AKD cellulosic composition obtainable by flowing a stream of a cellulosic suspension through a shearing device and in which a molten alkyl ketene dimer (AKD) is metered in to the stream of cellulosic suspension in or prior to the shearing device. In this aspect of the invention the cellulosic suspension may be regarded as the second stream of cellulosic suspension referred to in the first aspect of the invention.

The shearing device may be any suitable apparatus which generates significant shearing forces. Typically the shearing device can be a mixing pump or a milling device.

Mixing pumps generally have moving elements: such as rotating components, for instance impellers; kneeding components; or moving plates. The mixing pumps may also contain static elements such as baffles or plates, for instance containing orifices. The moving elements will tend to move quite rapidly in order to generate sufficient shear. This may be for instance at least 5 cycles per second (5 $s^{-1}$) and usually at least 10 $s^{-1}$, suitably at least 20 $s^{-}1$, typically up to 170 $s^{-1}$, up to 200 $s^{-1}$ or up to 300 $s^{-1}$ or more.

Milling devices include colloid mills, cone mills and rotor mills etc. In general milling devices tend to have moving elements, for instance cones, screens or plates containing gaps, grooves, slots or orifices which move against other static elements. The moving elements may move instance by rotation. These devices tend to generate a high level of shear stress on liquids and other materials passing through them. The moving elements tend to combine high-speed with a very small shear gap which produces intense friction on the material being processed. The friction and shear that result is commonly referred to as wet milling. In one form the milling device may contain a rotor and a stator, which are both cone shaped and may have one or more stages of fine grooves, gaps, slots or orifices. This stator can be adjusted to obtain the desired gap setting between the rotor and stator. The grooves, gaps, slots or orifices may change direction in each stage to increased turbulence. The moving elements will tend to move quite rapidly in order to generate sufficient shear. This may be for instance at least 5 cycles per second (5 $s^{-1}$) and usually at least 10 $s^{-1}$, suitably at least 20 $s^{-}1$, typically up to 170 $s^{-1}$, up to 200 $s^{-1}$ or up to 300 $s^{-1}$ or more.

Wet rotor mills, also called colloid mills, are used for the grinding or dispersion of particulate solids in suspension down to particle sizes less than 200 μm for grinding, less than 10 μm for de-agglomeration milling (dispersing) and for emulsification. For colloid mills with a gap geometry of the grinding chamber the core of the machine consists of a rotor and a stator with a circular and conical form resulting in an annular gap geometry. By an axial adjustment of rotor and stator against each other the gap width can be changed between 50 μm and 10 mm or between 100 μm and 10 mm or between 500 μm and 5 mm. Due to the rotation of the rotor with tip speeds which are usually between 1 and 100 m/s or between 10 and 50 m/s a high gradient shear field is generated in the liquid or the suspension. The suspension flows through the grinding chamber and the particles or agglomerates are stressed during the residence time by collisions with the grinding track (grinding) or in the shear field (dispersing) and ground or dispersed, respectively. The wet rotor mill with gap geometry generates a certain pumping power but must be supported by a pump if a huge delivery height or a high throughput is required. It can be operated in circuit or pass operation mode.

Preferred shearing devices include reaction mixing pumps or wet rotor mills.

Preferably the molten AKD should be added directly to the shearing device. The cellulosic suspension and molten AKD should remain in the shearing device for the desired amount of time (residence time). During this residence time the AKD cellulosic composition should be formed. The residence time in the shearing device may be, for instance at least 1 second. Often it will be at least 5 seconds and sometimes at least 10 seconds. It may be up to 30 seconds or more or it may be up to 15 seconds or up to 20 seconds.

In some situations it may be at least 20 seconds, for instance at least 1 min and often may be several hours, for instance up 10 hours or more. Suitably the residence time may be at least 5 min, suitably at least 10 min and often at least 30 min. In many cases it may be at least one hour. Typically the residence time will be up to 8 hours and desirably less than this.

In papermaking a cellulosic suspension tends to be made by blending one or a variety of cellulosic materials often with other additives and forming a suspension in water. Typically the cellulosic materials may include virgin wood fibre, for instance hardwood and/or softwood. It may also include recycled fibre, for instance from wastepaper. In accordance with the present invention the reference to first cellulosic suspension should include all cellulosic suspensions used in the wet end of the papermaking process.

The cellulosic suspension used for making the AKD cellulosic composition of the present invention may be made by conventional methods, for instance from wood or other feedstock. Deinked waste paper or board may be used to provide some of it. For instance the wood may be debarked and then subjected to grinding, chemical or heat pulping techniques, for instance to make a mechanical pulp, a thermomechanical pulp or a chemical pulp. The fibre may be bleached, for instance by using a conventional bleaching process, such as employing magnesium bisulphite or hydrosulphite. Other additives may have been incorporated into the cellulosic suspension, for instance optical brightening agents, whitening agents, dyes and/or fillers.

According to the process of the invention the AKD cellulosic composition may be metered into the first cellulosic suspension of the papermaking process at any convenient point in the wet end. For instance, the AKD cellulosic composition may be fed into the thin stock (low consistency cellulosic suspension) or alternatively may even be fed into the thick stock (high consistency cellulosic suspension). It may also be desirable to incorporate the AKD cellulosic composition at other convenient points. For instance, it may be desirable to add the AKD cellulosic composition into the mixing chest or even the blend chest. Alternatively, it may be desirable to incorporate the AKD cellulosic composition into the low consistency flow line of a dilution head box. In one preferred form, the AKD cellulosic composition would be incorporated into the thin stock suspension. In another preferred form, the AKD cellulosic composition would be incorporated into the thick stock suspension.

In one preferred aspect of the present invention the second stream of cellulosic suspension is flowed from the first cellulosic suspension. Desirably a portion of the first cellulosic suspension may be redirected, for instance along a conduit, to form the second stream of cellulosic suspension. Suitably this may be achieved by redirecting a portion of the thick stock cellulosic suspension or the thin stock cellulosic suspension.

Alternatively, the second stream of cellulosic suspension is provided independently of the first cellulosic suspension. In this aspect rather than redirecting a portion of the first cellulosic suspension, the second stream of cellulosic suspension may be formed by forming a suspension typically from the usual cellulosic and other stock components normally used for forming cellulosic suspensions.

The second stream of cellulosic suspension may have any suitable concentration or stock consistency. For instance, it may have the same stock consistency as either the thin stock or the thick stock corresponding to the first cellulosic suspension. Suitably the second stream of cellulosic suspension may have a concentration of up to 7% and usually up to 5%. Typically it may have a concentration of at least 0.01%, for instance at least 0.1% and typically at least 0.5% and suitably at least 1%. Often the second stream of cellulosic suspension may tend to have a concentration of suspended solids within the range of between 0.1% and 5% based on the total weight of suspension. Preferably the cellulosic suspension may have a concentration of between 1% and 4%.

The second stream of cellulosic suspension may be formed from any of the cellulosic stock material as described in regard to first cellulosic suspension.

Examples of suitable alkylketene dimmers (AKD) are tetradecyldiketene, stearyldiketene, lauryldiketene, palmityldiketene, oleyldiketene, behenyldiketene or mixtures thereof. Alkyldiketenes having different alkyl groups, such as stearylpalmityldiketene, behenylstearyldiketene, behenyloleyldiketene or palmitylbehenyldiketene, are also suitable. Stearyldiketene, palmityldiketene, behenyldiketene or mixtures of behenyldiketene and stearyldiketene are preferably used.

Generally the molten AKD will be essentially neat or pure AKD. By this we mean that the AKD will essentially contain no diluents and will be generally formed from at least 90% AKD and usually at least 95% AKD and normally at least 99% or even 100% AKD.

The amount of AKD that should be incorporated into the second stream of cellulosic suspension, and hence be present in the AKD cellulosic composition, should be normally at least 1000 ppm based on the dry weight of cellulosic suspension. In some cases this may be as much as 40% or more. Typically, this will be at least 1% and often at least 5%. Often the quantity of AKD may be at least 10% and sometimes at least 15%. Suitably the amount of AKD may be in the range of between 20% and 30% based on the dry weight of cellulosic suspension. In papermaking process of the present invention suitable doses of AKD cellulosic composition to incorporate into the first cellulosic suspension should be sufficient to provide an AKD dose of between 0.001% and 10%, for instance between 0.01% and 5% based on the total dry weight of final stock or paper.

Suitably the molten AKD should be formed by heating the AKD to a temperature above its melting point. Typically this may be to a temperature of at least 40° C. and more often to a temperature of at least 50° C. or even at least 60° C. In some cases the AKD making it to a temperature of up to 100° C. or usually up to a temperature of 90° C.

It may also be desirable to heat the second stream of cellulosic suspension prior to adding the molten AKD to a temperature above the melting point of the AKD in order to prevent any premature solidification of the AKD. Suitable temperatures include those recited above in regard to heating the AKD.

In a preferred aspect of the present invention the AKD cellulosic composition comprises nanocellulose and/or microfibrillated cellulose. It is thought that the action of the shearing device on the cellulosic suspension in the presence of molten AKD causes the formation of nanocellulose and/or microfibrillated cellulose. Preferably the AKD cellulosic composition comprises AKD in intimate association with said nanocellulose and/or microfibrillated cellulose. By this we mean that AKD may be in close proximity to nanocellulose and/or microfibrillated cellulose. For instance, the AKD may be in virtual contact with the nanocellulose and/or microfibrillated cellulose fibres or more usually in actual contact. The AKD may at least partially coat a portion of the nanocellulose and/or microfibrillated cellulose fibres.

Suitably the AKD cellulosic composition of the present invention will be formed as an aqueous suspension with AKD cellulosic composition dispersed throughout the aqueous phase. This aqueous composition can be conveniently used for introducing into other aqueous or liquid-based systems. Preferably in accordance with the first aspect of the invention and aqueous suspension of AKD cellulosic composition may be metered into the first cellulosic suspension in the wet end of the papermaking process.

The inventors unexpectedly found that incorporation of the AKD cellulosic composition into the papermaking process provides acceptable sizing characteristics. Thus we claim the use of the AKD cellulosic composition for sizing paper or paper products.

The inventors have also found that the AKD cellulosic composition may be formed into a solid layer, preferably as a film. This may be achieved by introducing the AKD cellulosic composition onto a suitable surface or into a suitable mould from which the solid layer can be cast. Suitable services include glass or metal surfaces.

The solid layer of AKD cellulosic composition suitably may have any length or width, for instance from several millimeters such as at least 10 or at least 50 mm to several meters, for instance up to 1 or up to 10 m or more. The solid layer may have even longer lengths if it is to be made into a roll, for instance up to several hundred meters, e.g. up to 500 m or more. Usually the solid layer of AKD cellulosic composition may have a thickness of at least several microns, typically at least 50 μm and usually at least 100 μm. Often the layer will have a thickness of at least 500 μm or even at least 700 or at least 800 μm. It may have a thickness of several millimeters or more, for instance up to 10 mm but usually not more than 5 mm and typically not more than 2 or 3 mm.

This AKD cellulosic composition layer has a variety of applications, including coating applications, for instance paper coating, packaging, insulators, in applications where combined hydrophobic and biological derived surfaces are desired.

The following examples illustrate the invention without in any way intending to be limiting.

EXAMPLES

Example 1

Preparation of the AKD Cellulosic Composition

Figure 2:
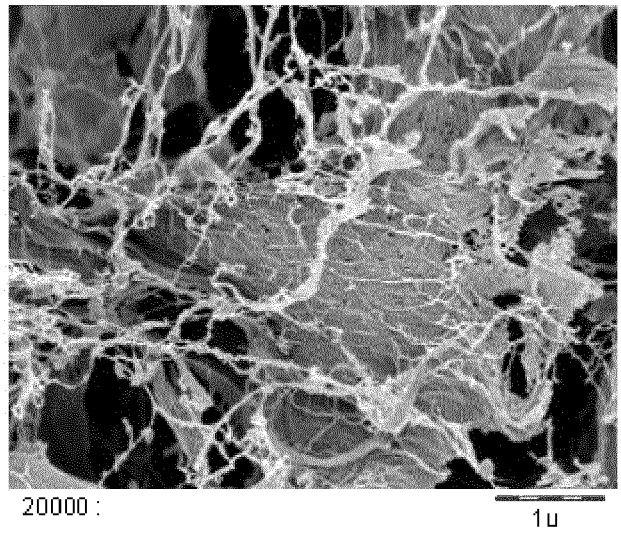
FIG. 2 is an SEM image of sample 2.

A cellulosic suspension derived from bleached kraft pulp was formed containing cellulosic fibre dispersed in water at a concentration of 3.7 wt %. The cellulosic suspension (680 g) was combined with molten AKD (6 g of Basoplast A20) and the mixture was sheared in a reaction mixing pump (RMP) for 2 hours (Sample 1) and 5 hours (Sample 2). Scanning Electron Microscope (SEM) images of sample 1 is shown in FIG. 1 and sample 2 is shown in FIG. 2.

Example 2

Preparation of Films of the AKD Cellulosic Suspension

Figure 3:
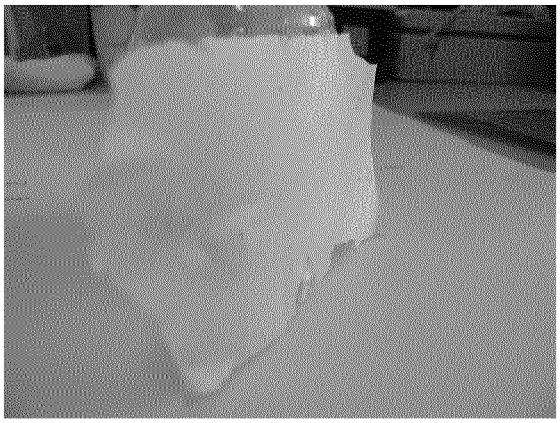
FIG. 3 is a photograph of the film cast of an upper side from sample 2.
Figure 4:
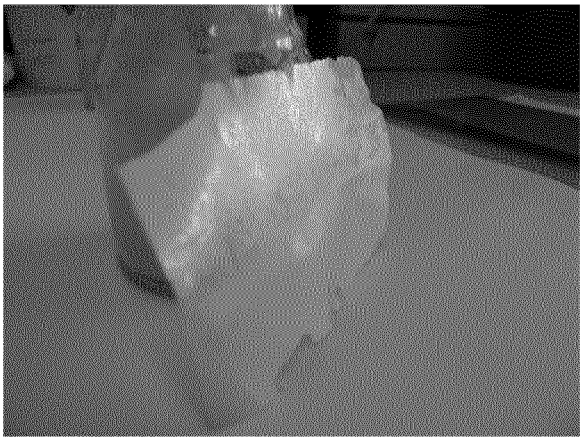
FIG. 4 is a photograph of the film cast from a lower side sample 2.
Figure 5:
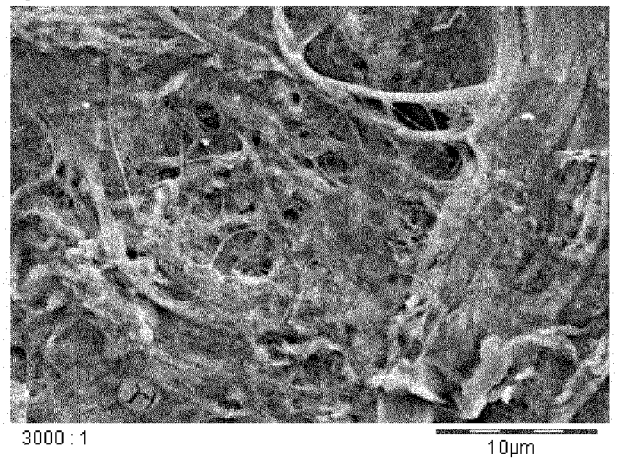
FIG. 5 is an SEM of the film cast from sample 2.

Films were cast onto a glass surface from both samples of AKD Cellulosic Suspension (Samples 1 and 2) using a casting knife. The films had a thickness of 1200 μm. The films were dried overnight at room temperature and work easily removed from the glass surface. Photographs of the film cast from Sample 2 are shown in FIG. 3 (upper side) and FIG. 4 (lower side). An SEM of the film cast from Sample 2 is shown in FIG. 5.

Figure 6:
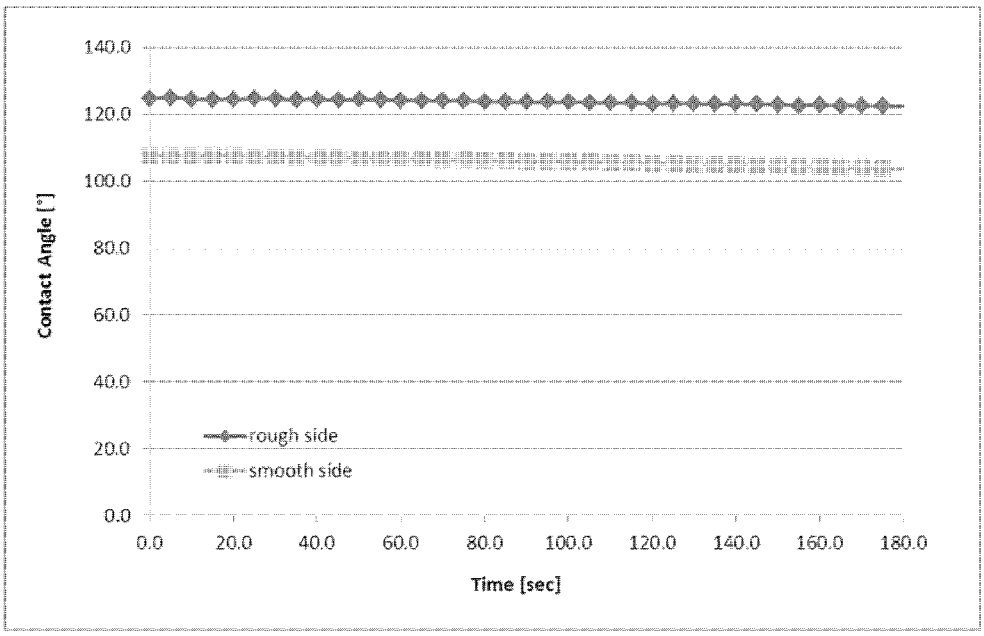
FIG. 6 is a plot of the contact angle versus time of the films of samples 1 and 2.

The hydrophobicity of films was measured by contact angle measurements against water. 3 μL of water was placed on the films every 5 seconds for 180 seconds. The measurement was carried out 3 times. The highly hydrophobic nature of the films was reflected by high contact angles (CA) reaching the values above 100°. In addition the films showed high stability as the contact angles were stable over 180 seconds. In general, materials are considered as highly hydrophobic when the contact angles of greater than 100° are achieved. The plot of contact angle with time is shown in FIG. 6.

Example 3

Process for the Preparation of Sized Paper

A papermaking stock was prepared from recycled pulp (100%) and having a stock density of 0.5% and a base weight of 80 g/m$^2$. A portion of this papermaking stock was fed into a reaction mixing pump (RMP). In addition a molten AKD was also fed into the reaction mixing pump at a dose of 4 g/t based on dry weight of papermaking stock. The mixture of papermaking stock and molten AKD were sheared for up to 10 min to form an AKD cellulosic composition. This AKD cellulosic composition was then metered into the papermaking stock to provide a dosage of AKD between 0.4% and 4% and then a paper sheet was formed on a wire mesh.

The sizing results are recorded in Table 1

TABLE 1

| Test | 1 | 2 | 3 | 4 | 5 | 6 |
|---|---|---|---|---|---|---|
| Amount of treated stock/ml | 50 | 100 | 250 | 300 | 400 | 500 |
| Amount of untreated stock/ml | 450 | 400 | 250 | 200 | 100 | 0 |
| Dose of AKD in paper (%) | 0.4 | 0.8 | 2.0 | 2.4 | 3.2 | 4.0 |
| Cobb 60 (g/m$^2$) | 25 | 24 | 20 | 19 | 19 | 19 |

Example 4

Process for the Preparation of Sized Paper

Example 3 was repeated except that the shearing device was a wet rotor mill and the residence time of the AKD and paper stock in the wet rotor mill was 15 min. The results are shown in Table 2.

TABLE 2

| Test | 1 | 2 | 3 | 4 | 5 | 6 | 7 |
|---|---|---|---|---|---|---|---|
| Dose of AKD in paper (%) | 1.02 | 0.102 | 0.204 | 0.306 | 0.408 | 0.51 | 0.051 |
| Cobb 60 ($g/m^2$) | 20 | 87 | 25 | 28 | 30 | 23 | 144 |

Example 5

Process for the Preparation of Sized Paper

Example 4 was repeated except that the residence time of the AKD and paper stock in the wet rotor mill was 50 seconds min. The results are shown in Table 3.

TABLE 3

| Test | 1 | 2 | 3 | 4 | 5 | 6 | 7 |
|---|---|---|---|---|---|---|---|
| Dose of AKD in paper (%) | 1.02 | 0.102 | 0.204 | 0.306 | 0.408 | 0.51 | 0.051 |
| Cobb 60 ($g/m^2$) | 19 | 46 | 27 | 24 | 22 | 20 | 113 |

We claim:

1. A process for the preparation of sized paper or paperboard, comprising:

forming a first cellulosic suspension, optionally adding to the first cellulosic suspension a papermaking additive;

flowing a second stream of a cellulosic suspension comprising virgin fiber or recycled fiber through a shearing device in which a molten alkyl ketene dimer (AKD) is metered into the second stream of cellulosic suspension in or prior to the shearing device to form an AKD cellulosic composition, wherein the AKD cellulosic composition comprises an aqueous suspension of nanocellulose or microfibrillated cellulose, or both, the AKD being in intimate association with the nanocellulose, microfibrillated cellulose, or both;

metering the AKD cellulosic composition into the first cellulosic suspension;

draining the first cellulosic suspension on a moving screen to form a sheet, and then drying the sheet.

2. The process according to claim 1, wherein the shearing device is a mixing pump.

3. The process according to claim 2, wherein the mixing pump, is a reaction mixing pump or a wet rotor mill.

4. The process according to claim 1, wherein the AKD cellulosic composition is metered into a thin stock cellulosic suspension.

5. The process according to claim 1, wherein the second stream of cellulosic suspension is flowed from the first cellulosic suspension.

6. The process according to claim 1, wherein the second stream of cellulosic suspension is provided independently of the first cellulosic suspension.

7. The process according to claim 1, wherein the second stream of cellulosic suspension has a concentration of suspended solids of between 0.1% and 5% by weight based on total weight of suspension.

8. The process according to claim 1, comprising heating the AKD to a temperature above a melting point thereof to form molten AKD.

9. The process according to claim 1, wherein the papermaking additive is added to the first cellulosic suspension.

10. The process according to claim 1, wherein the AKD cellulosic composition comprises of from 10 to 30% AKD based on the dry weight of the cellulosic suspension.

11. The process according to claim 1, wherein the AKD cellulosic composition comprises cellulose from wood or deinked waste paper or board.

* * * * *